United States Patent [19]

Groth et al.

[11] 4,275,651

[45] Jun. 30, 1981

[54] COMPACTOR REFUSE AND OTHER MATERIALS

[75] Inventors: Hugh F. Groth; Guilbert M. Hunt, both of Brecksville; Ronald E. Shaner, Rossburg, all of Ohio

[73] Assignee: Lambert Corporation, Dayton, Ohio

[21] Appl. No.: 151,196

[22] Filed: May 15, 1980

[51] Int. Cl.[3] ..... B30B 15/00

[52] U.S. Cl. ..... 100/229 A; 100/294; 53/527

[58] Field of Search ..... 100/229 A, 229 R, 100, 100/287, 294, 295; 141/73, 80; 53/527

[56] References Cited

U.S. PATENT DOCUMENTS

| | | | |
|---|---|---|---|
| 2,922,360 | 1/1960 | Monk | 100/229 R |
| 3,714,890 | 2/1973 | Moon | 100/229 A |
| 3,731,618 | 5/1973 | Leman | 100/229 A |
| 3,805,690 | 4/1974 | Goldkuhle | 100/229 A |
| 3,842,729 | 10/1974 | Mandrup | 100/287 X |
| 3,869,978 | 3/1975 | Steinberg | 100/229 A X |
| 3,885,467 | 5/1975 | Merkin | 100/229 A |
| 3,901,139 | 8/1975 | Moriconi | 100/229 A X |
| 4,008,658 | 2/1977 | Stock | 100/229 R X |

FOREIGN PATENT DOCUMENTS

| | | | |
|---|---|---|---|
| 2149351 | 4/1972 | Fed. Rep. of Germany | 100/229 A |

*Primary Examiner*—Billy J. Wilhite

[57] ABSTRACT

A cabinet has an upper portion which encloses a ram member movable vertically by a motor driven scissor-type actuator from an upper retracted position to a lower extended compacting position within a container positioned within the lower portion of the cabinet. The container is molded of a plastics material and is supported by a two-wheeled cart including pivotal arms which extend around an intermediate portion of the container and are locked together for restraining the container during compacting. When the container is tilted by the cart into a compacting position under the ram member, the container actuates a sealing frame which lowers and engages the upper rim of the container for confining within the upper portion of the cabinet any odors released by the material being compacted within the container.

18 Claims, 8 Drawing Figures

COMPACTOR REFUSE AND OTHER MATERIALS

BACKGROUND OF THE INVENTION

The present invention relates to vertical compactors for compressing refuse or other waste material and of the general type disclosed in U.S. Pat. Nos. 3,714,890, 3,731,618, 3,869,978, 3,885,467 and 3,901,139. Each of these patents discloses a cabinet enclosing a horizontal platen or ram which is movable in a vertical direction by a power operated fluid cylinder or actuator between a retracted upper position and an extended lower position for compacting material within an open top box-like container located within the lower portion of the cabinet. In each of the patents, the container is supported by two or more wheels which enable the container to be rolled into and out of the cabinet and to be transported to a remote location for either receiving a batch of waste material or for removing the compacted material from the container.

When such a compactor is designed for use in a private residence, and preferrably within a garage for the residence or for use by a small commercial establishment, it is highly desirable for the compactor to be of economical and simpified construction in addition to being compact in overall size and conveient to use. It is also desirable for the compactor to be constructed so that it confines any odors which might be released from the material being compacted within the container and to provide for conveniently removing a container of compacted material from the compactor and for conveniently removing the compacted material from the container.

SUMMARY OF THE INVENTION

The present invention is directed to an improved vertical compactor of the type disclosed in the above-noted patents and which provides all of the desirable features mentioned above. In general, these features are provided by a compactor which, in accordance with a preferred embodiment, incorporates a rectangular open top container molded of a semi-flexible plastics material. The container is supported and transported by a two-wheeled cart having pivotal arms which extend around a center or intermediate portion of the container and are locked together to restrain or confine the container and prevent it from bulging or expanding when material is compacted within the container. When the arms are released, the container and compacted material may be easily removed from the cart for disposing of the compacted material and for conveniently placing an empty container back on the cart.

When the container is returned to the cabinet and is tilted into the cabinet by means of the cart, the container actuates a sealing frame which engages the top rim of the cntainer and forms a seal between the container and the enclosed upper portion of the cabinet to confine any odors from the compacted material within the container.

Other features and advantages of the invention will be apparent from the following description, the accompanying drawings and the appended claims.

DESCRIPTION OF THE PREFERRED EMBODIMENT

Figure 1:
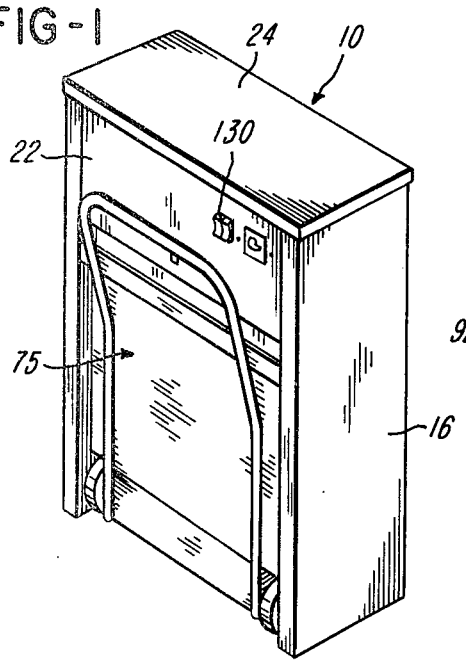
FIG. 1 is a perspective view of a vertical compactor constructed in accordance with the invention.

FIG. 1 illustrates a vertical compactor which incorporates a sheet metal cabinet 10 including a frame formed by a pair of parallel channel-like frame members 12 (FIG. 3) rigidly connected to a pair of parallel base frame members 14 by formed sheet metal end wall panels 16. The base frame members 14 are rigidly connected by a channel-like cross frame member 17 (FIG. 2), and the end wall panels 16 are also rigidly connected by a rear wall panel 19 and a front wall panel 22. A rectangular sheet metal cover 24 forms the top wall of the cabinet 10 and is removable to provide access to a chamber 26 defined within the uppper portion of the cabinet 10.

A compacting mechanism 30 is located within the chamber 26 in the upper portion of the cabinet 10 and includes an inverted U-shaped metal frame 32 which is mounted on the frame members 12 and is secured by bolts 33. A horizontal shaft 36 is rotatably supported by a set of aligned bearings 37 mounted on the frame 32 and includes a center portion rotatably supported within a stationary tube 39 secured to the frame 32 by a block 41. The shaft 36 has oppositely threaded end portions 42 which receive correspondingly threaded cylindrical nuts 44. The shaft 36 is driven alternately in opposite directions by a reversible motor 45 disposed within the frame 32 and having an output shaft coupled to the shaft 36 by a reducing chain drive 47.

The compacting mechanism 30 also includes a double scissors-type actuator 48 having a pair of arms 49 which interfit between another pair of arms 51, and the arm 49 and 51 are pivotally connected by a cross shaft 52. The upper end portions of the arms 49 and 51 are pivotally connected to the opposite ends of the corresponding cylindrical nuts 44. The lower end portions of the arms 49 are pivotally connected by a cross pin 54 to a corresponding pair of lower arms 56, and the lower end portions of the upper arms 51 are pivotally connected by another cross pin 54 to a corresponding pair of lower arms 58. The lower arms 56 and 58 support and carry a U-shaped platen or ram member 60 which is formed of heavy gauge steel and is connected to the lower end portions of the arms 56 and 58 by corresponding pivot rods 61.

Figure 4:
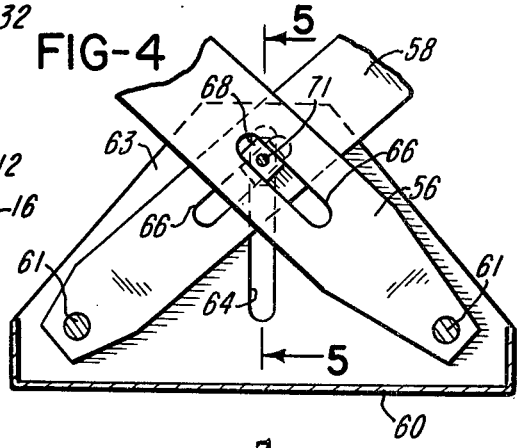
FIG. 4 is an enlarged fragmentary section of the compacting ram shown in FIG. 3.
Figure 5:
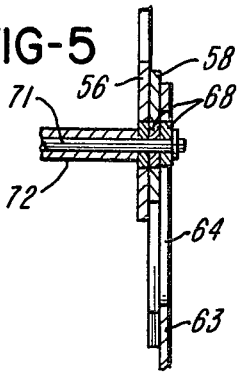
FIG. 5 is a fragmentary section taken generally on the line 5—5 of FIG. 4.

Referring to FIGS. 4 and 5, the ram member 60 has vertical side walls 63 in which are formed aligned vertical slots 64. Each of the arms 56 and 58 is also provided with a longitudinally extending slot 66, and each of the slots 64 and 66 receives a corresponding rectangular slide block 68. The blocks 68 on each side of the ram member 60 are mounted on a cross rod 71 which extends through a tubular spacer 72 positioned between the inner arms 56 of the scissor-type actuator 48.

By reversing the motor 45, the compacting platen or ram member 60 is movable through the actuator 48 between a retracted upper position (FIG. 2) and an extended lower position (FIGS. 3 and 6), and the slide blocks 68 cooperate with the corresponding slots 64 and 66 to stabilize the ram member 60 and maintain its bottom surface horizontal at all times while the ram member moves between its retracted and extended positions.

The lower portion of the cabinet 10 defines a chamber or compartment 74 (FIG. 2) having a front opening for receiving a mobile cart 75. The cart 75 includes a formed metal bottom wall or base 76 (FIG. 8) from which extend a pair of opposite side wall panels 78 rigidly connected by a substantially flat rear wall panel 81 having an offset angular upper flange portion 82. The bottom wall or base 76 also has an upwardly projecting front flange portion 83, and an axle 86 extends horizontally through aligned holes in the side walls 78 for supporting a pair of wheels 88. The two-wheeled cart also includes an inverted U-shaped handle member 92 which is formed from metal tubing and includes lower leg portions 94 rigidly secured to the base 76 and rear wall panel 81 of the cart.

Figure 2:
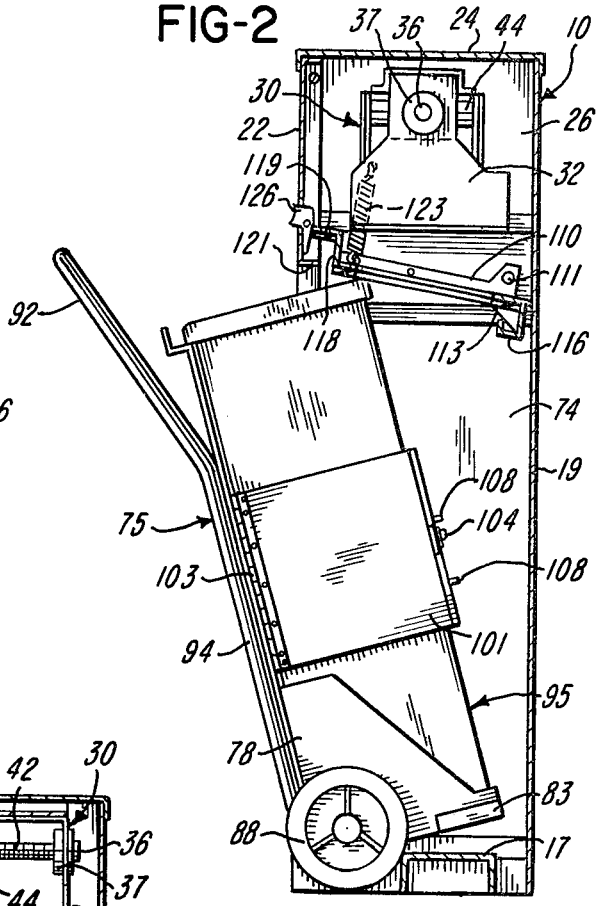
FIG. 2 is a vertical section through the compactor cabinet and illustrating a container being inserted or removed from the cabinet.
Figure 7:
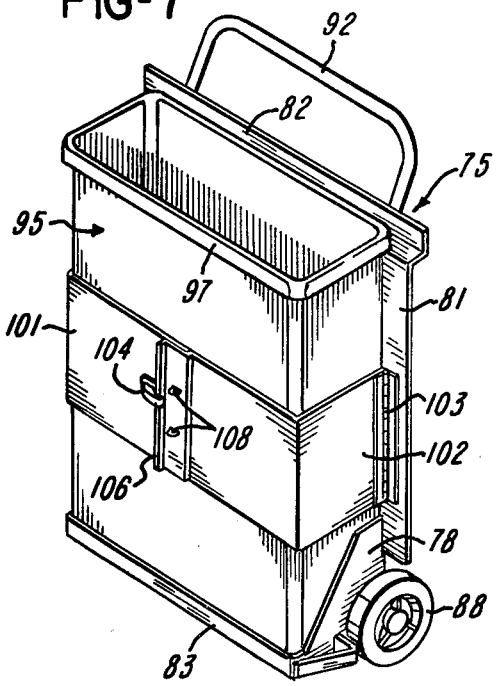
FIG. 7 is a perspective view of the cart and container assembly during transporting of a container of during compacting of material within the container.

As best shown in FIG. 2, the cart 75 is adapted to support and carry a rectangular container 95 which is molded of a semi-rigid plastics material such as polypropolyene. The container illustrated has a capacity of approximately twenty gallons and is rectangular in horizontal cross-section so that the bottom wall of the container seats on the bottom wall or base 76 of the cart 75 between the side walls 78 and within the flange 83, as shown in FIG. 7. The container 95 is molded with an upper peripheral rim portion 97 which has an inverted U-shaped cross-sectional configuration, and one side of the rim portion projects over the angular flange portion 82 of the rear wall panel 81 of the cart 75.

As intermediate or center portion of the container 95 is restrained or confined by a pair of L-shaped metal arms 101 and 102 each of which is pivotally supported by a hinge 103 mounted on the rear wall panel 81 of the cart 75. The configuration and size of each arm 101 and 102 is such that the arm contacts the outer surface of the container 95, and the outer end portion of the arm 102 overlaps the outer end portion of the arm 101. A toggle actuated latch 104 is mounted on the outer end portion of the arm 101 and engages a flange 106 on the outer end of the arm 102 for locking the arms together (FIG. 7) for positively and rigidly confining the intermediate portion of the container 95. A pair of ears 108 (FIG. 7) project from the outer end portion of the arm 101 through corresponding slots 109 within the outer end portion of the arm 102 to aid in coupling the arms together and to maintain lateral alignment of the arms.

Figure 6:
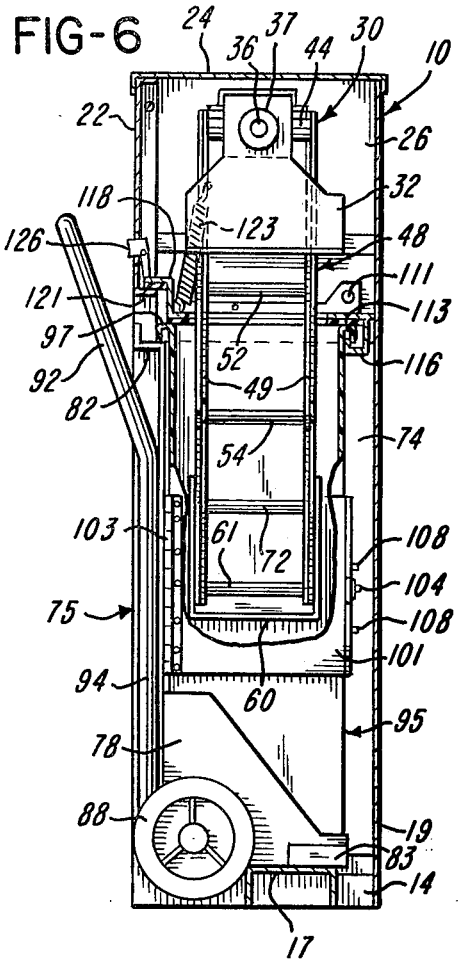
FIG. 6 is a vertical section of the cabinet and with a portion of the cart and container broken away to illustrate the position of the cart and container in the compacting position as also shown in FIG. 3.

Referring to FIGS. 2 and 6, a rectangular frame-like sealing member 110 is pivotally supported within the upper portion of the cabinet 10 by a pair of aligned pivot pins 111 mounted on the frame members 12. The sealing frame 110 includes a peripherally extending resilient seal or gasket 113 which is adapted to engage the rim portion 97 of the container 95 when the container is placed in a compacting position within the chamber 74, as shown in FIG. 6. The sealing frame 95 further includes a downwardly projecting rear flange portion 116 (FIG. 6) which is adapted to be engaged by the outer wall of the container 95. The sealing frame 110 also includes an upwardly projecting and inverted L-shaped front flange portion 118 which carries a resilient sealing strip 119 adapted to engage an inwardly projecting flange 121 along the bottom of the front wall panel 22. The sealing frame 110 is normally biased in an incline or sloping position (FIG. 2) by a tension coil spring 123 extending between the frame 110 and the actuator frame 32.

When the container 95 is tilted into the cabinet chamber 74 by means of the cart 75, the outer wall of the container 95 engages the rear flange portion 116 of the sealing frame 110 and causes the frame to pivot counterclockwise (FIG. 2) against the force exerted by the spring 123 until the resilient gasket 113 contacts the upper rim surface of the container 95, as shown in FIG. 6. The sealing frame 110 is retained or locked in this engaging position by means of a thumb actuated latch lever 126. The lever 126 is pivotally supported by the front wall panel 22 and has a lower end surface which engages the front flange portion 118 of the sealing frame 110. In this latched position, the frame 110 forms a seal between the cabinet chamber 26 and the container 95 so that any odors released from material being compacted within the container 95 are confined within the container 95 and the upper portion or chamber 26 of the compactor cabinet 10.

When it is desired to use the compactor for compressing a batch of waste material, the operator depresses the latch lever 126 to release the sealing frame 110. The container 95 is then tilted rearwardly by means of the cart 75, as shown in FIG. 2, so that a batch of material may be placed within the container. When the cart 75 is tilted to return the container to a vertical position within the compartment 74, the outer wall of the container 95 engages the rear flange portion 116 of the sealing frame 110 and automatically tilts the frame 110 to its sealing position (FIG. 6) where the frame is automatically latched by the pivotal latch lever 126. When the sealing frame 110 returns to its sealing position, it actuates or closes an interlock switch 128 (FIG. 3) which enables the motor 45 to be operated. As also shown in FIG. 6, when the cart 75 and container 95 are tilted to a vertical compacting position, the bottom wall or base 76 of the cart 75 engages and seats on the cross channel or frame member 17 of the cabinet 10, thereby elevating the cart wheels 88 slightly above the floor.

Figure 3:
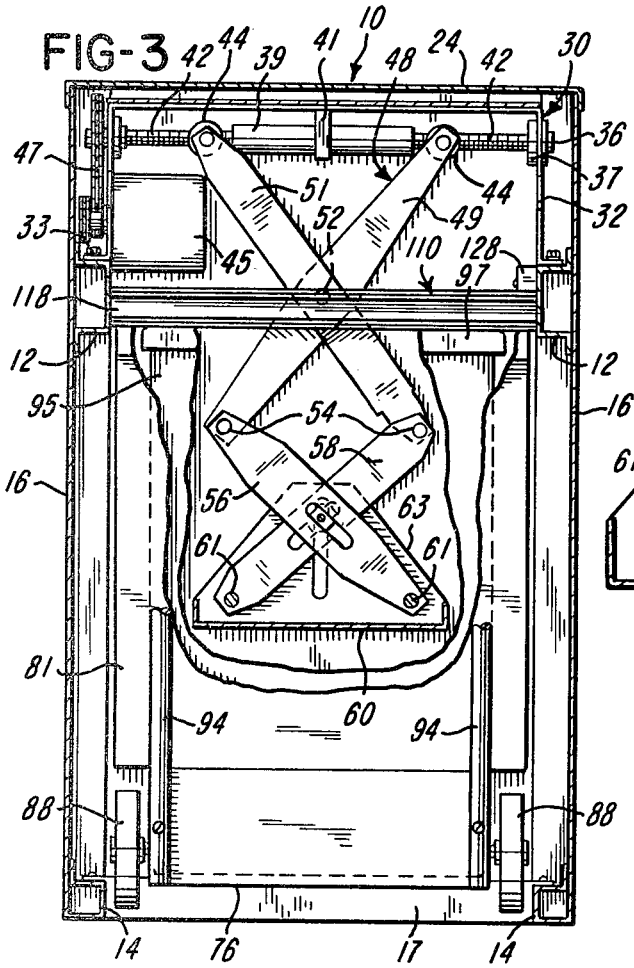
FIG. 3 is a front elevational view of the compactor with a portion of the cabinet, cart and container broken away to illustrate the ram member and actuator in a compacting position.

The compacting of the material within the container 95 is commenced or initiated by depressing a rocker-type off-on switch 130 (FIG. 1) mounted on the front wall panel 22 of the cabinet 10. This energizes the motor 45 which drives the threaded shaft 36 causing the ram member 60 to move downwardly through the sealing frame 110 and into the container 95, as shown in FIGS. 3 and 6. When the shaft 36 meets a predetermined torque resistance either due to the nuts 44 engaging the ends of the tube 39 or the ram member 60 exerting a predetermined pressure on the material within the container 95, the motor 45 automatically reverses to retract the ram member 60 upwardly to its fully retracted position (FIG. 2) within the upper portion of the cabinet 10.

After the container 95 is substantially filled with compacted material by repeating the above operations for each batch of material which is added to the container 95 and it is desired to remove the container of compacted material, the latch lever 126 is depressed to release the sealing frame 110, and the cart 75 is tilted rearwardly from the compartment 74. The container 95 and its contents are then transported by the cart 75 to a location where the container 95 may be emptied. At this location, the latch 104 is released and the arms 101 and 102 are pivoted to open positions (FIG. 8) so that the container 95 and its contents may be easily removed from the cart in order to empty the container.

From the drawings and the above description, it is apparent that a vertical compactor constructed in accordance with the present invention, provides desirable features and advantages. For example, the compactor provides for conveniently adding a batch of material to the container 95 without removing the cart 75 and container 95 simply by tilting the cart and container rearwardly, as illustrated in FIG. 2 to expose the top opening of the container. This tilting movement of the cart and container is permitted by the pivotal sealing frame 110 which is also responsive to the return of the container 95 for automatically producing a generally airtight seal between the container and the enclosed upper portion of the cabinet 10.

Figure 8:
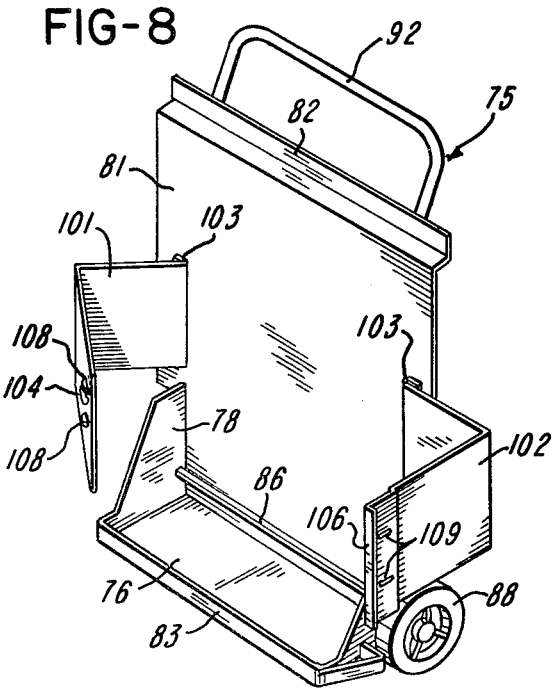
FIG. 8 is a perspective of the cart shown in FIG. 7 and with the container removed.

As another important feature, the cart 95 permits the use of a relatively light weight and inexpensive plastic molded container 95 to form the compacting chamber. That is, the pivotal arms 101 and 102 cooperate with the rear panel 81 of the cart to confine an intermediate portion of the container and to prevent the container from expanding or bulging in response to the compressing of material within the container. It is also within the scope of the invention to enlarge the arms 101 and 102 so that they engage and back-up a larger area of the front wall of the container 95, if necessary, for use with a higher compacting pressure or a thinner wall container. As shown in FIG. 8, the arms 101 and 102 may also quickly be released or uncoupled so that the container 95 and its compacted contents may be conveniently removed from the cart 75 without the need for lifting the container and its contents from an open top chamber. The construction of the ram number 60 and its assembly to the scissor-type actuating mechanism 48, also provides for positively stabilizing the ram member so that it is prevented from tilting during the compacting operation.

While the form of vertical compactor herein described constitutes a preferred embodiment of the invention, it is to be understood that the invention is not limited to this precise form of compactor, and that changes may be made therein without departing from the scope and spirit of the invention as defined in the appended claims.

The invention having thus been described, the following is claimed:

1. In a vertical compactor adapted for compressing batches of refuse or other waste material and including a frame, a generally horizontal ram member, actuator means mounted on said frame and supporting said ram member for generally vertical movement, an open top container positioned at a compacting station within said frame below said ram member and adapted to receive the material, power operated means for moving said actuator means to move said ram member between a retracted upper position and an extended lower position within said container for compressing the material within said container, and a wheel supported cart including a base member supporting the bottom wall of said container and providing for moving said container into and out of said compacting station, the improvement wherein said container comprises an open top container of molded plastics material and having an intermediate wall portion between said open top and said bottom wall, said cart including restraining means above said base member and extending in a confining position around said intermediate wall portion of said container for maintaining substantially the shape of said molded plastic container during compacting, and said restraining means being movable between said confining position and a released position to provide for conveniently removing said container laterally from said cart.

2. A compactor as defined in claim 1 wherein said container is generally rectangular in horizontal cross-section, said cart including a set of generally parallel side walls engaging said container, said cart further including a rear wall member engaging said container, and said restraining means include a front wall member movable between said released position and said confining position extending generally parallel to said rear wall member.

3. A compactor as defined in claim 1 wherein said restraining means comprise a set of arms extending generally around said intermediate wall portion of said container and pivotable between said confining and released positions, and releasable lock means for securing said arms together in said confining position.

4. A compactor as defined in claim 3 wherein said container has a generally rectangular horizontal cross-section, and at least one of said arms has a generally L-shaped configuration.

5. A compactor as defined in claim 1 wherein said container is generally rectangular in horizontal cross-section, said restraining means include a rear wall member adjacent one side of said container, and said restraining means further include a movable arm member extending adjacent the other side of said container.

6. A compactor as defined in claim 1 wherein said frame comprises a cabinet defining an upper chamber disposed above said container and enclosing said power operated means, and an odor confining member supported by said frame for movement between a first position forming a seal between said container and said cabinet and a second position providing for the removal of said cart and said container from said cabinet.

7. In a vertical compactor adapted for compressing batches of refuse or other waste material and including a cabinet having an upper chamber and a lower chamber, a generally horizontal ram member disposed within said upper chamber, actuator means supporting said ram member for generally vertical movement, a container positioned within said lower chamber below said ram member and having an upper rim portion defining a top opening for receiving the material, power operated means for moving said actuator means to move said ram member between a retracted upper position and an extended lower position within said container for compressing the material within said container, and a wheel supported cart supporting said container and providing for moving said container into and out of said lower chamber, the improvement comprising an odor confining member, means supporting said odor confining member for movement between a lower sealing position engaging said rim portion of said container and a retracted upper position providing for removing said container with said cart, means for moving said odor confining member between said sealing and retracted positions, and said odor confining member forming a seal between said container and said cabinet when said member is in said sealing position for confining any odors within said container and said upper chamber.

8. A compactor as defined in claim 7 wherein said odor confining member is movable between said sealing and retracted positions in response to movement of said container into and out of said lower chamber.

9. A compactor as defined in claim 7 wherein said odor confining member comprises a generally rectangular sealing frame having peripherally extending means for engaging said rim portion of said container, and pivot means supporting said frame for pivotal movement between a generally horizontal said sealing position and said retracted position inclining upwardly and forwardly from said pivot means to provide for tilting said container into and out of said lower chamber with said cart.

10. A compactor as defined in claim 9 wherein said sealing frame has a downwardly projecting rear flange portion positioned to be engaged by said container and an upwardly projecting front flange portion, and means forming a generally air-tight seal between said front flange portion and said cabinet when said frame is in said sealing position.

11. A compactor as defined in claim 7 and including releasable latch means for securing said odor confining member in said sealing position, and spring means urging said odor confining member to said retracted position.

12. A compactor as defined in claim 7 wherein said odor containing member comprises a generally rectangular sealing frame disposed between said container and said ram member in said retracted position.

13. A compactor as defined in claim 7 wherein said ram member includes substantiallly parallel side walls, said actuator comprises a scissor-type actuator including a series of interfitting arms, means defining slots within said arms and said side walls of said ram member, a set of slide blocks disposed within said slots for sliding movement, and a cross rod supporting said blocks for independent rotation.

14. A compactor as defined in claim 7 wherein said container comprises an open top container of molded plastics material, and said cart includes means for confining an intermediate portion of said container to avoid bulging of said container portion during compacting.

15. A compactor as defined in claim 14 wherein said means for confining said container comprise a set of pivotally supported L-shaped arms on said cart, and means for releasably securing said arms together in a position confining said container.

16. In a vertical compactor adapted for compressing batches of refuse or other waste material and including a cabinet defining an upper chamber and a lower chamber, a ram member disposed within said upper chamber, actuator means supporting said ram member for generally vertical movement, a container positioned within said lower chamber below said ram member and having an upper rim portion defining a top opening for receiving the material, power operated means for moving said actuator means to move said ram member between a retracted upper position and an extended lower position within said container for compressing the material within said container, and a wheel supported cart supporting said container and providing for moving said container into and out of said lower chamber, the improvement comprising an odor confining member, means supporting said odor confining member for movement between a lower sealing position engaging said rim portion of said container and a retracted upper position providing for removing said container with said cart, means for moving said odor confining member between said retracted position and said sealing position forming a seal between said container and said cabinet to confine any odors within said container and said upper chamber, said cart including restraining means extending in a confining position around an intermedite portion of said container for maintaining substantially the shape of said container during compacting, and said restraining means being movable between said confining position and a released position providing for conveniently removing said container laterally from said cart.

17. A compactor as defined in claim 16 wherein said container is generally rectangular in horizontal cross-section and comprises a molded plastics material, said cart including a rear wall member engaging said container, and said restraining means include a front wall member movable between said released position and said confining position extending generally parallel to said rear wall member.

18. A compactor as defined in claim 16 wherein said restraining means comprises a set of L-shaped arms extending generally around said intermediate wall portion of said container and pivotable between said confining and released positions, and releasable lock means for securing said arms together in said confining position.

* * * * *